US006676724B1

(12) United States Patent
Narasimhan et al.

(10) Patent No.: US 6,676,724 B1
(45) Date of Patent: Jan. 13, 2004

(54) POWDER METAL VALVE SEAT INSERT

(75) Inventors: Sundaram L. Narasimhan, Marshall, MI (US); Yushu Wang, Marshall, MI (US); Heron A. Rodrigues, Charlotte, NC (US)

(73) Assignee: Eaton Corporation, Cleveland, OH (US)

( * ) Notice: Subject to any disclaimer, the term of this patent is extended or adjusted under 35 U.S.C. 154(b) by 28 days.

(21) Appl. No.: 10/183,289

(22) Filed: Jun. 27, 2002

(51) Int. Cl.[7] ..... C22C 33/02
(52) U.S. Cl. ..... 75/243; 75/231; 75/246
(58) Field of Search ..... 75/243, 246, 231

(56) References Cited

U.S. PATENT DOCUMENTS

| | | | | |
|---|---|---|---|---|
| 4,241,895 A | | 12/1980 | Sternenberg et al. | 251/173 |
| 4,964,908 A | * | 10/1990 | Greetham | 75/241 |
| 5,007,284 A | | 4/1991 | Slone | 73/120 |
| 5,271,823 A | | 12/1993 | Schachameyer et al. | 205/224 |
| 5,482,637 A | | 1/1996 | Rao et al. | 252/29 |
| 5,649,994 A | | 7/1997 | Holko | 75/255 |
| 5,674,449 A | | 10/1997 | Liang et al. | 420/12 |
| 5,679,909 A | | 10/1997 | Kaneko et al. | 75/246 |
| 5,759,227 A | | 6/1998 | Takahashi et al. | 75/246 |
| 5,784,681 A | * | 7/1998 | Purnell et al. | 419/11 |
| 5,934,238 A | | 8/1999 | Wang et al. | 123/188.3 |
| 5,960,760 A | | 10/1999 | Wang et al. | 123/188.3 |
| 6,139,598 A | | 10/2000 | Narasimhan et al. | 75/246 |
| 6,214,080 B1 | | 4/2001 | Narasimhan et al. | 75/255 |
| 6,385,847 B1 | | 5/2002 | Larson et al. | 29/888.451 |

OTHER PUBLICATIONS

Valve Gear Wear and Materials, 851497, S. L. Narasimhan and J. M. Larson.

Wear, The Effect of Operating Conditions on Heavy Duty Engine Vale Seat Wear Y. S. Wang, S. Narasimhan, J. M. Larson, and G. C. Barber, Wear 201 (1996) 15–25.

Sintered Valve Seat Inserts and Valve Guides: Factors Affecting Design, Performance & Machinability, H. Rodrigues, Admitted Prior Art.

* cited by examiner

*Primary Examiner*—Ngoclan Mai
(74) *Attorney, Agent, or Firm*—Daniel S. Kalka; L. J. Kasper

(57) ABSTRACT

A powder metal engine component particularly suited for use as a valve seat insert in both light and heavy duty internal combustion engine applications. The powder metal engine component contains an intermetallic phase such as a Laves phase for both the cobalt or iron based alloy.

19 Claims, 3 Drawing Sheets

POWDER METAL VALVE SEAT INSERT

BACKGROUND OF THE INVENTION

1. Field of the Invention

The present invention relates in general to a powder metal engine component, and more particularly to a new and improved powder metal valve seat insert useful in both light and heavy duty internal combustion engine applications.

2. Description of the Related Art

The operation cycle of an internal combustion engine is well known in this art. The physical requirements for the intake and exhaust valves, valve guides and valve seat inserts to effectively interact in sealing the combustion have been studied extensively. Still engine and vehicle manufacturers constantly seek ways to meet more stringent wear and cost reduction challenges in manufacturing engine components for providing cost-effective engines that operate longer. Powder metallurgy has recently been employed in the manufacture of engine components and permits latitude in selecting a variety of metallic or even ceramic compositions as well as offering design flexibility. The powder metallurgy process is a highly developed method of manufacturing ferrous and nonferrous parts. Some advantages of the powder metallurgy process include but are not limited to minimizing scrap losses, minimizing machining, maintaining close dimensional tolerances, providing materials with a controlled porosity for self-lubrication or infiltration, and manufacturing complex shapes.

Valve seat inserts for internal combustion engines require high wear resistance materials for operation at elevated temperatures for prolonged periods of time. Additionally, valve seat inserts require high creep strength and high thermal fatigue strength even under repeated impact loading at elevated temperatures. Typically, the valve seat insert materials that are made from high alloy powders have low compressibility. Therefore, processes such as double pressing, double sintering, high temperature sintering, copper infiltrating, and hot forging are used to achieve a desired density level. Unfortunately, these additional steps can make the material prohibitively expensive. Internal combustion engines can operate on a wide variety of fuels, for example, gasoline, both leaded or unleaded fuel, diesel, or alternative fuels such as CNG (compressed natural gas). The heavy duty or truck engine applications operate at even higher combustion pressure than in light duty or passenger car applications and so require even better wear resistance materials. It is further known that exhaust valve seat inserts operate under more elevated temperatures than intake valve seat inserts. To provide all of the different types of valve seat inserts for these wide variety of applications becomes technically impractical and economically burdensome.

It is known that wear resistance, both abrasive and adhesive, are prime requirements for valve seat inserts used in internal combustion engines. In an effort to achieve a combination of good heat and corrosion resistance and machinability coupled with good wear resistance, valve seat inserts have been made from cobalt, nickel, or martensite iron based alloy castings. These alloys have been generally preferred over austenitic heat-resistance steels with high chromium and nickel content because of the presence of wear resistant carbides in the cast alloys. However, the cobalt or nickel based alloys are typically more expensive.

Thus, there still exists a need for a new powder metal engine component, and particularly a valve seat insert suitable for most internal combustion engine applications for both exhaust and intake valves whether in a heavy duty truck application or a lighter application such as in a passenger car. Preferably, such a powder metal valve seat insert may be used with any type of internal combustion engine fuel including, but not limited to, gasoline, leaded or unleaded, diesel, or any alternative fuel like natural gas. The powder metal valve seat insert should exhibit superior properties of abrasive and adhesive wear resistance against various types of valve materials.

BRIEF SUMMARY OF THE INVENTION

Accordingly, an object of the present invention is to provide a new powder metal engine component for an internal combustion engine.

Another object of the present invention is to provide a new powder metal valve seat insert that is suited for use in a wide variety of internal combustion engine applications.

Still another object of the present invention is to provide an improved powder metal valve seat insert particularly suited for operation in heavy duty truck engine applications.

Still another object of the present invention is to provide an improved powder metal valve seat insert suited for operation in an internal combustion engine capable of operating on any of a variety of fuels including, but not limited to, gasoline, both leaded or unleaded fuel, diesel, or an alternative dry fuel such as CNG, alcohol based fuel or mixtures thereof.

Still a further object of the present invention is to provide an improved powder metal valve seat insert that has superior properties in hardness, hot hardness, abrasive and adhesive wear resistance.

The above and other objects of the present invention are accomplished with an improved powder metal engine component comprising a material alloy similar in composition to Tribaloy alloys, in particular either a cobalt or iron based alloy, containing an intermetallic phase such as a Laves phase. Tribaloy is a registered trademark of Deloro Stellite Inc. The iron based powder metal engine component in accordance with the present invention comprises a chemical composition on a weight percent basis carbon (C) in an amount ranging from about 0.5 to about 1.5%; chromium (Cr) in an amount ranging from about 1.0 to about 4.0%; molybdenum (Mo) in an amount ranging from about 2.0 to about 8.0%; manganese (Mn) in an amount ranging from about 0.2 to 0.9%; vanadium (V) in an amount ranging from about 0.1 to about 0.8%; copper (Cu) in an amount ranging from about 0 to about 20.0%; nickel (Ni) in an amount ranging from about 0.2 to about 3.5%; sulfur (S) in an amount ranging from about 0.2 to about 0.8%; tungsten (W) in an amount ranging from about 0.2 to about 0.6% and the balance being substantially iron (Fe).

An alternate embodiment of the powder metal component in accordance with the present invention comprises a chemical composition on a weight percent basis carbon (C) in an amount ranging from about 0.7 to about 1.4%; chromium (Cr) in an amount ranging from about 1.0 to about 4.0%; molybdenum (Mo) in an amount ranging from about 6.0 to about 12.0%; silicon (Si) in an amount ranging from about 0.1 to about 1.0%; nickel (Ni) in an amount ranging from about 0.5 to about 3.5%; sulfur (S) in an amount ranging from about 0.2 to about 1.0%; cobalt (Co) in an amount ranging from about 4.0 to about 15.0%; copper (Cu) in an amount ranging up to about 20%; and the balance being substantially iron (Fe).

The various features of novelty which characterize the invention are pointed out with particularity in the claims annexed to and forming a part of this disclosure. For a better understanding of the invention, its operating advantages, and specific objects attained by its uses, reference is made to the accompanying examples, drawings, and descriptive matter in which a preferred embodiment of the invention is illustrated.

DETAILED DESCRIPTION OF THE INVENTION

The present invention resides in an improved powder metal engine component particularly suited for use as a valve seat insert. The powder metal valve seat insert according to the present invention offers superior properties of abrasive and adhesive wear resistance, high temperature resistance, hot hardness and machinability. The powder metal valve seat insert in accordance with the present invention is useful in a wide variety of internal combustion engine applications such as in a heavy duty truck application or even in a light duty passenger car application. It can be employed with various types of valve materials including hard-faced and nitrided valves. The powder metal valve seat insert in accordance with the present invention may be used in an internal combustion engine operating on any of a variety of fuel sources including, but not limited to, gasoline, both leaded or unleaded fuel, diesel, or alternative dry fuels such as alcohol based fuels, CNG or propane, or mixtures thereof.

In the specification, unless otherwise specified, all temperatures are in degrees Celsius (° C.) and all percentages (%) are on a weight percent basis.

Figure 1:
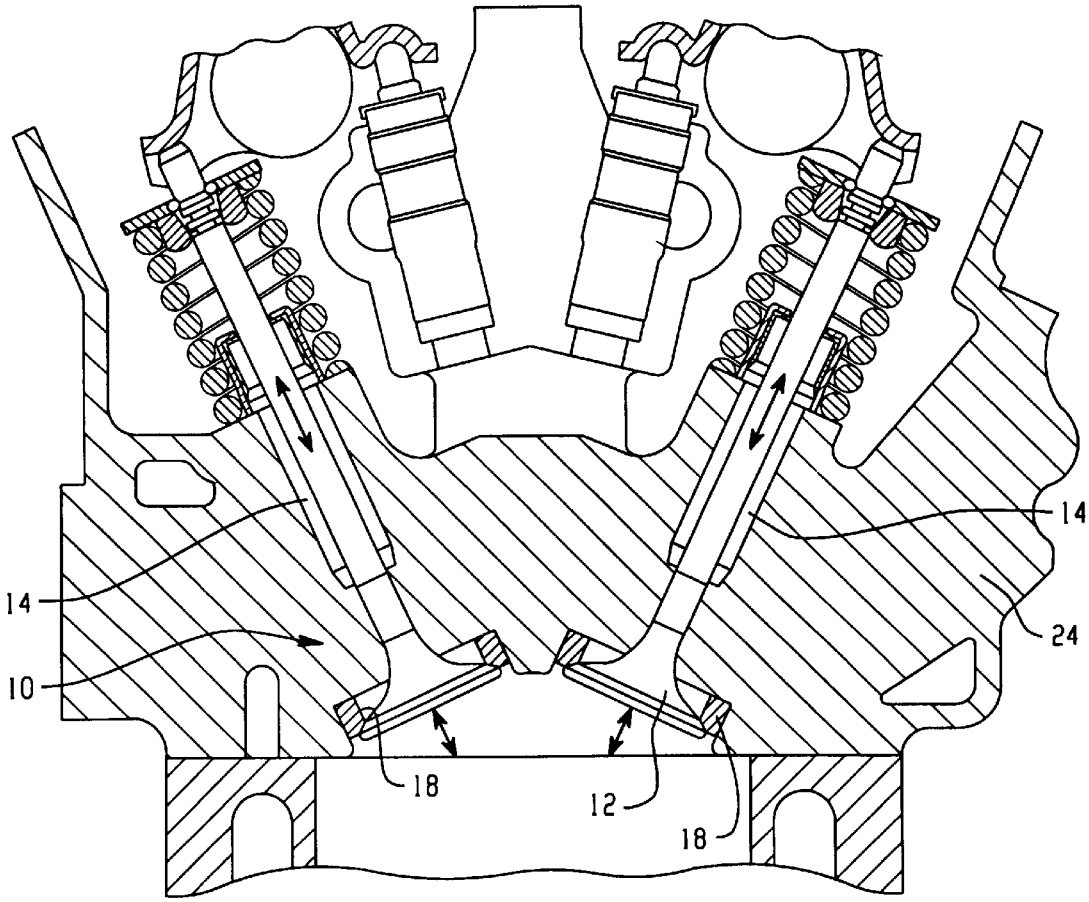
FIG. 1 is a cross sectional view illustrating a valve assembly in a portion of an engine.
Figure 2:
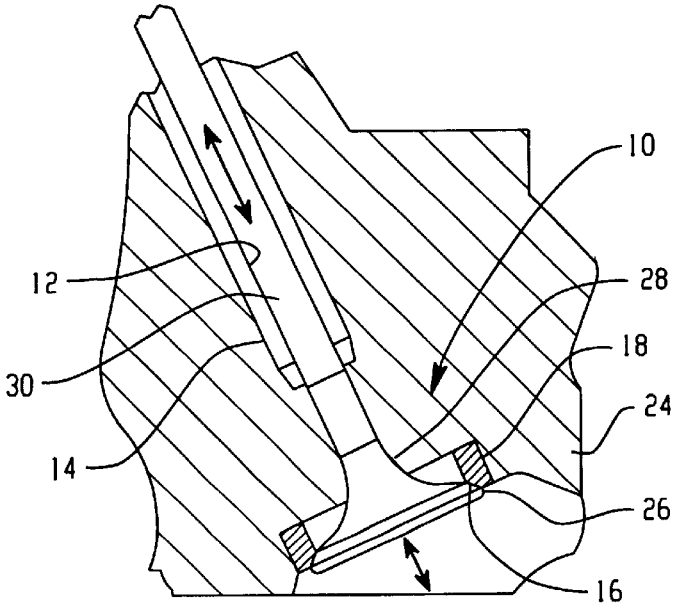
FIG. 2 is a cross sectional view illustrating a portion of the valve assembly including a valve seat insert in more detail.

Referring first to FIGS. 1 and 2, there is illustrated a valve assembly generally designated 10 for use in an engine. These valve assembly drawings are being provided for illustrative purposes only to facilitate a better understanding of the present invention. Valve assembly 10 includes a plurality of valves 12 each reciprocatingly received within the internal bore of a valve stem guide 14. The valve stem guide 14 is essentially a tubular structure which is inserted into the cylinder head 24. These engine components are devices well known to those skilled in this art, and need no detailed explanation on their operation herein. The present invention is not intended to be limited to any specific structure since modifications and alternative structures are provided by various manufacturers.

Valve 12 includes a valve seat face 16 interposed between the valve head and fillet 28 of the valve 12. Valve stem 30 is located normally upwardly of neck 28 and usually is received within valve stem guide 14. A valve seat insert 18 is normally mounted within the cylinder head 24 of the engine. Preferably, the valve seat insert 18 is substantially annular in shape with a cross-section shown, and cooperatively receives the valve seat face 16 for sealing engagement therewith The first iron based embodiment of the powder metal blend according to the present invention uses a blend of materials that comprise on weight percent basis the following: about 5 to about 15% iron based alloy containing an intermetallic phase such as Laves phase similar to that contained in Tribaloy T10, preferably about 10%; about 3% to about 10% tool steel powder, such as, M3 tool steel powder commercially available from Powdrex, preferably about 5%; about 1% to about 2% solid lubricant, such as $CaF_2$ and $MoS_2$ or mixture thereof, preferably about 1.5%; about 0.2% to 0.8% solid lubricant such as Talc, preferably about 0.5%; about 0.2% to 0.8% fugitive lubricant such as Acrawax C; preferably about 0.5%; about 0.5% to about 1.2% graphite, preferably about 0.8%; and the balance being substantially a low alloy powder containing about 0 to about 3% Cr preferably about 0.5%; about 0 to about 4% Ni, preferably about 1%; about 0.5 to about 1.5% Mo, preferably about 1%; 0 to about 0.8% V, preferably about 0.25%, and the balance being substantially Fe. The second cobalt containing embodiment of the powder metal blend in accordance with the present invention comprises on a weight percent basis a mixture of about 10% to about 40% T-400 Tribaloy powder (or equivalent CoMoCrSi powder, preferably about 35%; about 1% to about 5% solid lubricant, such as $MoS_2$, preferably about 3%; about 1% to about 2% graphite, preferably about 1.5%; and the balance being substantially a low alloy base powder such as Distaloy AE which is commercially available from Hoeganaes Corporation.

The suitable tool steel powder for use in the present invention includes, but is not limited to, M series steel powders commercially available from Powdrex with the M3 powder being preferred.

$MOS_2$ is the preferred solid lubricant for the present invention, but other lubricants like $CaF_2$ or talc or mixtures thereof with $MoS_2$ may be employed. Suitable solid lubricants include, but are not limited to, powdered hydrated magnesium silicate (commonly referred to as talc), Acrawax C, and other disulfide or fluoride type solid lubricants known in this art.

A suitable source for graphite powder is Southwestern 1651 grade which is a product of Southwestern Industries Incorporated.

A suitable commercial source for the copper powder is OMG Americas. This company is also a suitable source for a low alloy powder, such as a 434 Powder, used for the cobalt contained powder metal blend according to the second embodiment of the present invention.

The low alloy powder employed in the iron based powder metal blend in accordance with the first embodiment of the present invention is preferably a QMP 4701 powder commercially available from Quebec Metal Powders.

The powder metal blend is thoroughly mixed for a sufficient time to achieve a homogenous mixture. Normally, the mixture is blended for about thirty minutes to about two hours, and preferably for about an hour to result in a homogenous mixture. Any suitable mixing means such as a ball mixer or double cone blender may be employed.

The mixture is then compacted with a conventional press at a conventional compacting pressure ranging from about 50 tons per square inch (TSI) to about seventy-five tons per square inch (about 760 to about 1140 Mpa) with a preferred pressure of less than about 65 TSI (about 988 Mpa). Pressures above about 65 TSI, while useful, may be prohibitively expensive. Conversely, while pressures lower than 50 TSI may be employed, any pressure lower than about 35 TSI is hardly ever used. The compacting pressure is adequate to press and form a compact to a near net shape or even a net shape having a desired density ranging from about 6.5 grams per cubic centimeter ($g/cm^3$) to about 7.4 $g/cm^3$. Preferably, the density is 6.8 $g/Cm^3$. In order for a powder metal engine component to work in a severe engine environment, like in a heavy duty truck application, the powder metal engine component should be capable of being compacted to a minimum density of 6.5 $g/cm^3$. Compaction is done generally with a die of the desired shape. The compaction can be performed either uniaxially or isotacticly. The green compact is conveyed to a conventional sintering furnace where sintering of the compact takes place. Sintering is a bonding of adjacent surfaces in the compact by heating the compact below the liquidus temperature of the majority of the ingredients in the compact.

The sintering conditions employed in the present invention use conventional sintering temperatures, which typically range from about 1,040° C. to about 1,150° C., and preferably at a temperature of about 1,100° C. A higher sintering temperature may alternatively be employed ranging from about 1,250° C. to about 1,350° C., and preferably about 1,300° C. for about twenty minutes to about one hour, or more preferably about thirty minutes in a reducing atmosphere of an inert gas or gaseous mixture, including without limitation nitrogen ($N_2$), hydrogen ($H_2$), or argon (Ar), or under vacuum. The alloy of the present invention can be used in either the "assintered" condition or in a heat treated condition. The heat treatment methods for powder metallurgy are well known in this art.

The powder metal material of the present invention can be coined at room temperature or hot forged to form a work hardened surface, or to increase the density for increased wear resistance. In addition, the powder metal material of the present invention can be copper infiltrated to increase the density for increased wear resistance.

The iron based powder metal engine component of first embodiment manufactured in accordance with the above composition and manner has a chemical composition on a weight percent basis that comprises about 0.5 to about 1.5% carbon (C); about 1.0 to about 4.0% chromium (Cr); about 0.3 to 0.9% manganese (Mn); about 3.0 to about 7.0% molybdenum (Mo); about 0.1 to about 0.5% vanadium (V); about 0.2 to about 2.0% nickel (Ni); about 0.2 to about 0.8% sulfur (S); about 0.2 to about 0.6% tungsten (W); about 0 to about 20% copper (Cu); and the balance being substantially iron (Fe). The powder metal engine component has an apparent hardness ranging from about 100 to about 120 HRB on the Rockwell B Scale.

The preferred chemical composition for the iron based Laves phase powder metal engine component comprises: 1.05% C, 2.0% Cr, 11.0% Cu, 0.1% Mg, 0.58% Mn, 4.23% Mo, 0.72% Ni, 0.47% S, 0.33% V, 0.36% W, and the balance being substantially Fe.

The powder metal engine component according to the second cobalt containing embodiment of the present invention has a chemical composition on a weight percent basis that comprises about 0.7 to about 1.4% carbon (C); about 1.0 to about 3.0% chromium (Cr); about 6.0 to about 12.0% molybdenum (Mo); about 0.5 to about 3.0% nickel (Ni); about 0.1 to about 1.0% silicon (Si); about 0.2 to about 0.8% sulfur (S); about 4.0 to about 15.0% cobalt (Co); up to about 20% copper (Cu) and the balance being substantially iron (Fe). The powder metal engine component has an apparent hardness ranging from about 100 to about 120 HRB on the Rockwell B Scale.

The preferred chemical composition for the cobalt based Laves phase powder metal engine component comprises: 1.29% C, 15% Co, 2.2% Cr, 0.89% Cu, 9.51% Mo, 2.67% Ni, 0.7% S, 0.86% Si, and the balance being substantially Fe.

Figure 3:
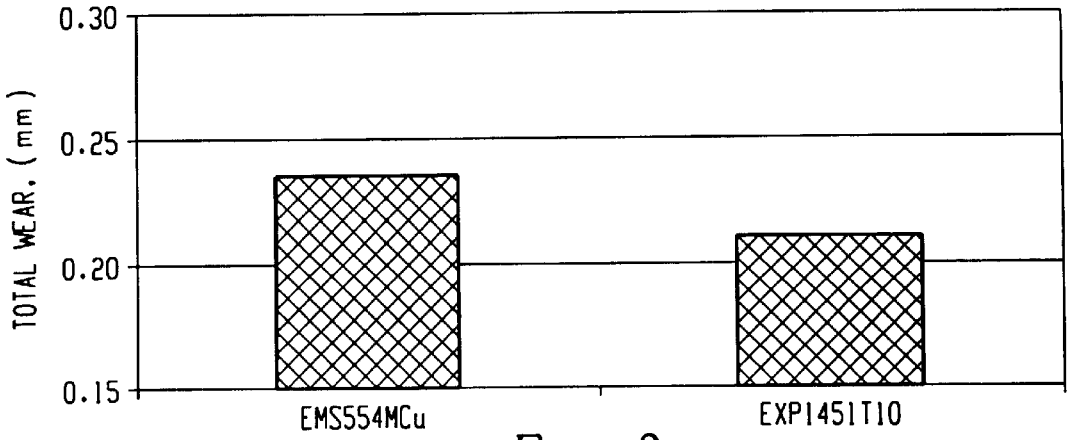
FIG. 3 is a graph showing valve seat insert rig test results for a commercially available valve seat material and a first iron based embodiment according to the present invention.

FIG. 3 is a graph showing the valve seat insert rig test results of a commercially available material labeled EMS554MCul and a valve seat insert made according to the first embodiment labeled EXP1451. A description of the rig wear test procedures appears in an article by Y. S. Wang, et al., "The Effect of Operating Conditions on Heavy Duty Engine Valve Seat Wear," WEAR 201 (1196), and is described in U.S. Pat. No. 5,271,823, which is assigned to the Assignee of the present invention and hereby incorporated by reference. In these tests, a valve made from 21–2N material had its stem subjected to a sideload of about 273 kilograms (kg) of force and was operated at a cycle rate of 20 Hertz (Hz) for approximately 1,440,000 cycles. The valve seat was heated to a temperature of about 677° C.

Figure 4:
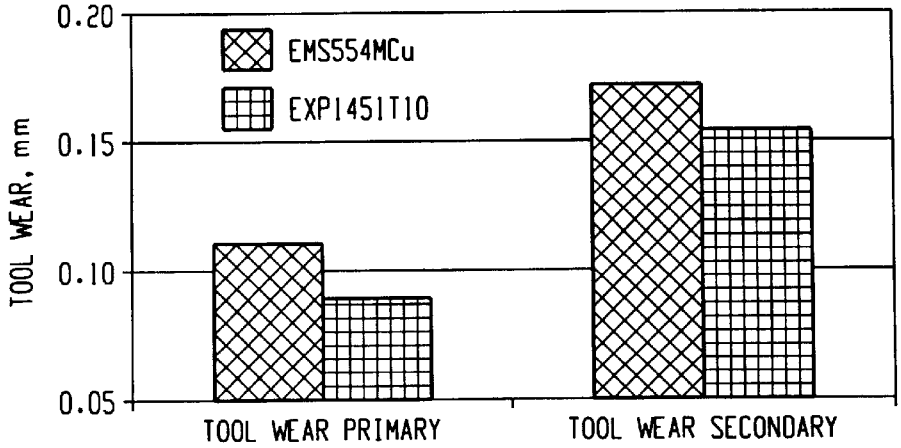
FIG. 4 is a graph showing a comparison of the machinability of the first iron based embodiment of the present invention with the commercially available material of FIG. 3.

FIG. 4 shows a comparison of machinability of the same materials of FIG. 3 under two conditions labeled "Tool Wear Primary" and "Tool Wear Secondary". A description of the machinability testing procedures are given in a paper by H. Rodrigues, "Sintered Valve Seat Inserts and Valve Guides: Factory Affecting Design, Performance and Machinability," Proceedings of the International Symposium on Valvetrain System and Design Materials (1997). The operating parameters of the test included a CBN (Cubic Boron Nitride) machine with coolant operating at about 1550 rpm and a feed rate of 9.3 ipm.

A careful review of these figures shows the improvement in desired characteristics achieved with the present invention over the prior art.

Figure 5:
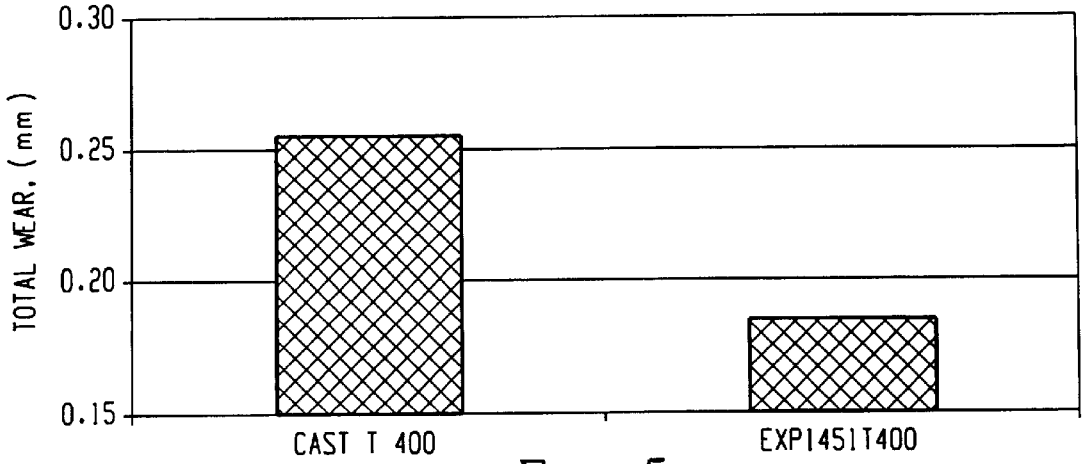
FIG. 5 is a graph showing valve seat insert rig test results for a cast T400 material and a second cobalt containing embodiment of the present invention.

FIG. 5 is a graph showing valve seat insert rig test results for a cast T-400Tribaloy material and the cobalt containing PM material according to the second embodiment of the present invention. Cast T-400 Tribaloy insert is for the premium heavy duty diesel application. These rig tests were performed with a salt bath nitrided Sil 1 valve. The valve seat is at a temperature of about 510° C. The valve stem is subjected to a side load of about 1814 kilograms (kg) of force at a cycle rate of about 10Hz for approximately 864,000 cycles. Again, the improvement of the present invention over a cast T-400 Tribaloy material is clearly shown. This represents a significant machinability improvement over the cast T-400 insert which is difficult to machine and is usually used in a pre-finished form.

Figure 6:
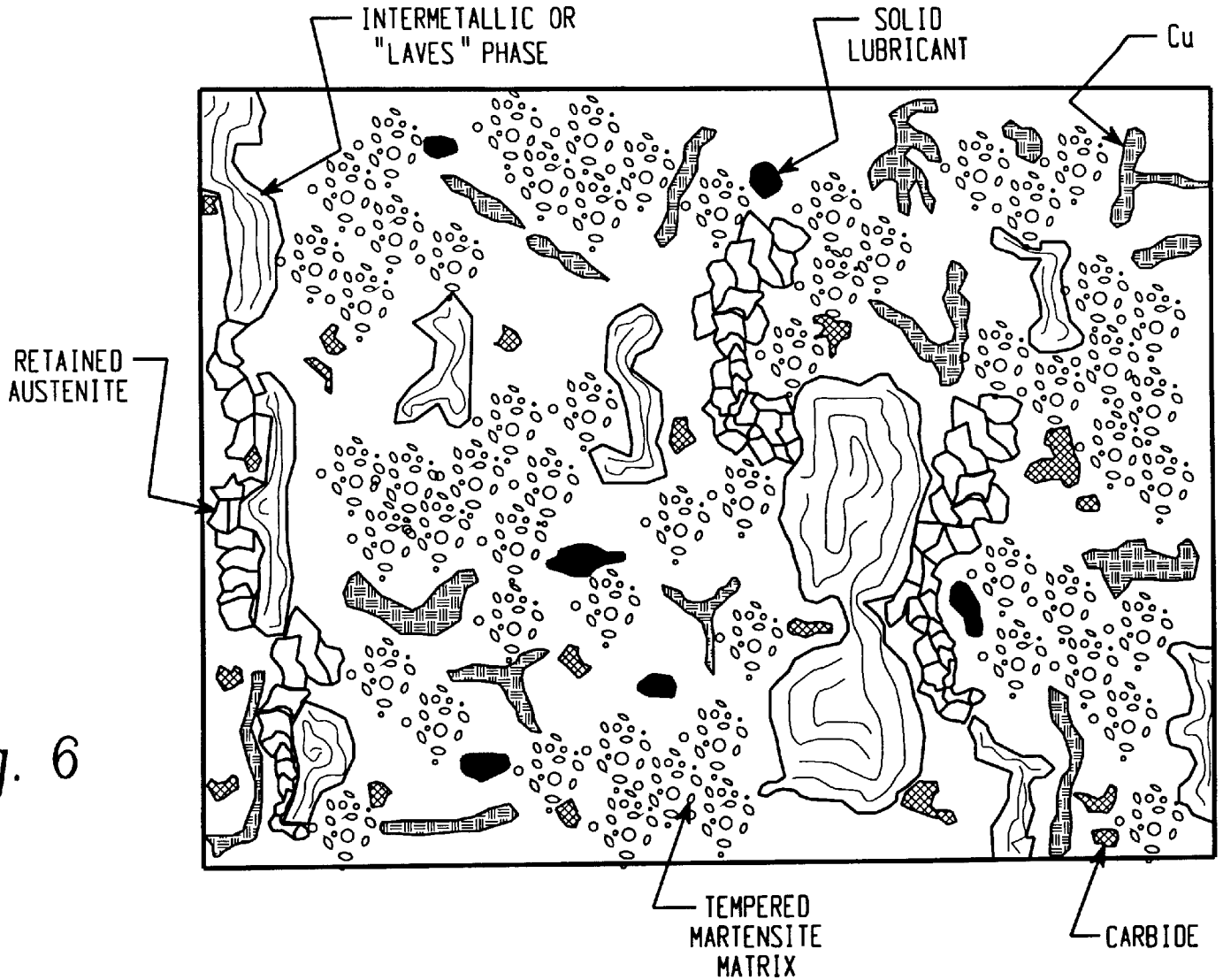
FIG. 6 is a sectional microstructure illustration of a powder metal component made in accordance with the present invention.

FIG. 6 is a sketch illustrating the microstructure of the powder metal blend material of the instant invention. The intermetallic or Laves phase which is present in both embodiments of the present invention is identified. The Laves phase provides heat and wear resistance. There is also shown the solid lubricant, carbide and porosity filled with copper alloy for lubricity and machinability in the tempered martensitic matrix. The retained austenite phase is also shown in the microstructure.

The present invention advantageously discovered that far less than 100% of iron based intermetallic material similar to Tribaloy or T-400 alloying amounts can be effectively employed for adequate wear resistance in heavy duty and light duty applications. The novel intermetallic microstructure combined with the solid lubricants provide valve seat inserts with improved wear resistance and superior machinability which can be manufactured at competitive prices.

The lower expense of the iron based intermetallic iron based intermetallic material similar to Tribaloy T 10 powder metal blends provides cost advantages particularly for use in mass production passenger car applications.

The cobalt based intermetallic phase of the T-400 powder metal blend of the present invention provides wear resistance for heavy duty applications. While its machinability or cost is not as attractive as the first embodiment, the second embodiment finds particular utility in truck engine applications.

EXAMPLE I

The iron based powder in accordance with the present invention is blended using the following formulation in a double cone blender for about thirty minutes. The blend consists of 100kg iron based intermetallic powder, 50 kg M3 powder, 15kg $MOS_2$, 5 kg talc, 10 kg graphite powder, 6 kg Acrawax C, and 814 kg QMP 4701 powder. The blend is then compacted to a density of 6.8 g/cm$^3$. Sintering is conducted in a reduced atmosphere of 90% nitrogen with balance of hydrogen at 2100° F. for twenty to thirty minutes. Sintering is followed by carburizing at 1600° F. for two hours at 1.0 carbon potential and oil quenching, then followed by tempering at 800° F. for one hour in nitrogen atmosphere. This material may also be Cu infiltrated during sintering if desired.

EXAMPLE II

The cobalt containing blend in accordance with the present invention is processed as in Example I but the blend comprises the following materials and weights: 350 kg T400 powder, 16 kg graphite powder, 30 kg $MoS_2$, 10kg talc, 5 kg Acrawax C, and 589 kg Distaloy AE.

Although the present invention has been described with a certain degree of particularity, it is understood that the description of the preferred embodiment is by way of example only and that numerous changes to form and detail are possible without departing from the spirit and scope of the invention as hereinafter claimed.

We claim:

1. A powder metal engine component having a chemical composition on a weight percent basis, comprising:

about 0.5 to about 1.5% of C;
about 1.0 to about 4.0% of Cr;
about 0.3 to about 0.9% of Mn;
about 3.0 to about 7.0% of Mo;
about 0.1 to about 0.5% of V;
about 0.2 to about 2.0% of Ni;
about 0.2 to about 0.8% of S;
about 0.2 to about 0.6% of W;
about 0 to about 20.0% of Cu; and
the balance substantially being Fe.

2. A powder metal engine component as recited in claim 1, wherein said engine component comprises a valve seat insert.

3. A powder metal engine component as recited in claim 1, wherein said powder metal engine component comprises a powder metal material compacted to a minimum density of about 6.5 g/cm$^3$.

4. A powder metal engine component as recited in claim 3, wherein said compacted powder metal material comprises a hardness on a Rockwell B scale ranging from about 100 to about 120.

5. A powder metal engine component as recited in claim 4, wherein said compacted powder metal material comprises a microstructure in which a Laves phase, a carbide, and solid lubricant are dispersed in a matrix containing tempered martensite, pearlite, bainite, and austenite.

6. A powder metal engine component as recited in claim 5, wherein said component includes being in an as-sintered and tempered condition.

7. A powder metal engine component as recited in claim 5, wherein said component includes being in a copper infiltrated condition.

8. A powder metal engine component as recited in claim 5, wherein said component includes being in a steam treated condition.

9. A powder metal engine component as recited in claim 5, wherein said component includes being in a condition that is a member selected from the group consisting of a carburized and tempered condition, a carbonitrided and tempered condition.

10. A powder metal engine component having a chemical composition on a weight percent basis, comprising:

about 0.7 to about 1.4% of C;
about 1.0 to about 3.0% of Cr;
about 6.0 to about 12.0% of Mo;
about 0.1 to about 1.0% of Si;
about 0.5 to about 3.0% of Ni;
about 0.2 to about 0.8% of S;
about 4.0 to about 15.0% of Co;
up to about 20.0% of Cu; and
the balance substantially being Fe.

11. A powder metal engine component as recited in claim 10, wherein said engine component comprises a valve seat insert.

12. A powder metal engine component as recited in claim 10, wherein said powder metal engine component comprises a powder metal material compacted to a minimum density of about 6.5 g/cm$^3$.

13. A powder metal engine component as recited in claim 12, wherein said compacted powder metal material comprises a hardness on a Rockwell B scale ranging from about 100 to about 120.

14. A powder metal engine component as recited in claim 12, wherein said compacted powder metal material comprises a microstructure in which a Laves phase, a carbide, and a solid lubricant are dispersed in a tempered martensitic matrix.

15. A powder metal engine component as recited in claim 14, wherein said solid lubricant comprises a member selected from the group consisting of $MOS_2$, $CaF_2$, talc, graphite, and a mixture of $MoS_2$, talc, graphite and $CaF_2$.

16. A powder metal engine component as recited in claim 15, wherein said component includes being in an as-sintered and tempered condition.

17. A powder metal engine component as recited in claim 15, wherein said component includes being in a copper infiltrated condition.

18. A powder metal engine component as recited in claim 15, wherein said component includes being in a steam treated condition.

19. A powder metal engine component as recited in claim 15, wherein said component includes being in a condition that is a member selected from the group consisting of a carburized and tempered condition, and a carbonitrided and tempered condition.

* * * * *